United States Patent [19]

Blewitt et al.

[11] Patent Number: 4,528,537

[45] Date of Patent: Jul. 9, 1985

[54] HIGH CURRENT ZINC OXIDE FUSE

[75] Inventors: Donald D. Blewitt, Penn Hills Township, Allegheny County; Tapan K. Gupta, Monroeville, both of Pa.

[73] Assignee: Westinghouse Electric Corp., Pittsburgh, Pa.

[21] Appl. No.: 569,068

[22] Filed: Jan. 9, 1984

[51] Int. Cl.[3] ..... H01H 85/00

[52] U.S. Cl. ..... 337/5; 337/4; 337/158; 337/293

[58] Field of Search ..... 337/4, 5, 158, 161, 337/162, 229, 273, 293; 338/215; 361/2, 104

[56] References Cited

U.S. PATENT DOCUMENTS 1,889,585 11/1932 Zodrow et al. ..... 337/273

3,294,938 12/1966 Kozacka ..... 337/229

*Primary Examiner*—Harold Broome

*Attorney, Agent, or Firm*—M. J. Moran

[57] ABSTRACT

There is provided by this invention a current limiting fuse having a zinc oxide core electrically connected in parallel with an array of wire fuse elements capable of shaping and controlling the arc voltage developed during current interruptions.

5 Claims, 4 Drawing Figures

HIGH CURRENT ZINC OXIDE FUSE

CROSS-REFERENCE TO RELATED APPLICATIONS

This application is related to Ser. No. 569,053, filed Jan. 9, 1984.

BACKGROUND OF THE INVENTION

1. Field of the Invention

This invention relates generally to current limiting fuses and more particularly to current limiting fuses capable of shaping and controlling the arc voltage developed by the fuse during high current interruptions.

2. Description of the Prior Art

The application of current limiting fuses having the conventional notched design in the fuse element has presented a particular problem in applications for rotating rectifiers where failure occurs in the reduced cross-sections of the fuse element due to the mechanical and electrical stress incurred under normal operation. To avoid this problem in the conventional design would require that the element notches be eliminated. The uniform element thus created could result in the generation of unacceptably high arc voltage levels during fault current interruption. It would be desirable if there were provided a current limiting fuse for use in rotating rectifier equipment that provided the arc voltage control characteristics of the conventional notch-type fuse element or fuse elements having reduced cross-sectional area and was capable of withstanding the high mechanical and electrical stress associated with applications such as rotating rectifier equipment.

SUMMARY OF THE INVENTION

There is provided by this invention a current limiting fuse having arc voltage control characteristics and fuse element construction able to withstand high mechanical and electrical stress associated with rotating rectifier applications.

DESCRIPTION OF THE PREFERRED EMBODIMENT

Figure 1:
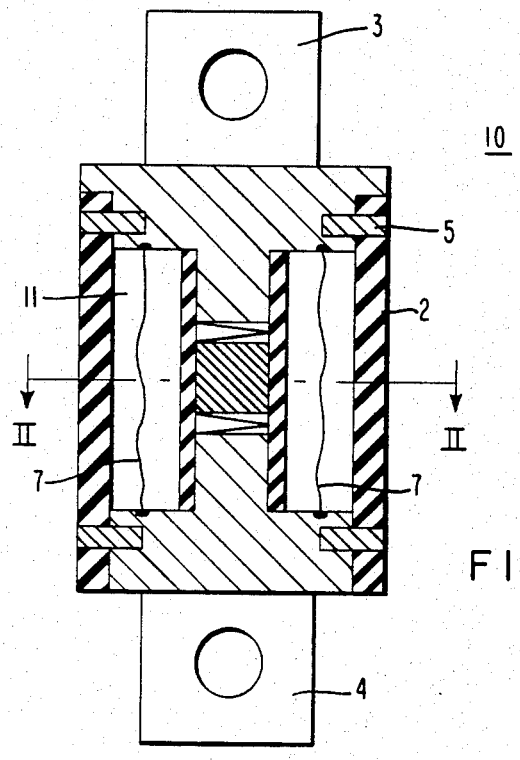
FIG. 1 is a sectional view of a current limiting fuse incorporating the principles of this invention.
Figure 2:
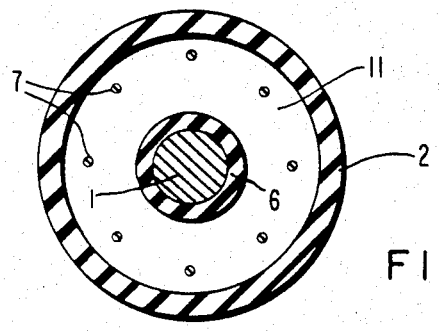
FIG. 2 is a sectional view taken generally along the lines II—II of FIG. 1.

There is shown in FIGS. 1 and 2 a current limiting fuse 10 comprised generally of an insulating tubular housing 2 sealed by electrically conducting terminal end caps 3 and 4 attached to the insulating housing by means of retaining pins such as 5. Traversing the length of the insulating tubular housing is a shielding tube 6 positioning a non-linear resistor element 1 such as zinc oxide in the center thereof. The shielding tube 6 may be of any suitable insulating material such as ceramic, glass melamine, mica, or the like, that keeps the zinc oxide cylinder firmly positioned between the two electrically conducting end terminals and shields the zinc oxide surface and the extended areas of the terminals from possible contamination by arc products generated by the fusible elements during the interruption process. An array of 8 wire fuse elements such as 7 of uniform cross-section are concentrically arranged around the zinc oxide cylinder 1 at the center of the fuse. The fuse elements are connected electrically to the terminal end caps 3 and 4 in parallel with the zinc oxide cylinder. The length of the zinc oxide is determined by the required arc voltage clamping level. The spring contacts 8 and 9 shown between the ends of the zinc oxide cylinder and the conductive end terminals may be provided to insure good electrical contact by maintaining a positive force between the zinc oxide cylinder 1 and the terminals of the fuse. The wire elements 7 may be of high electrical conductivity silver drawn to any of a large number of standard commercial diameters, allowing much design flexibility and ease of construction regarding the desired current rating and electrical resistance of the fuse. Because the wires have a uniform cross-section they are not subject to the type of cyclic load current failures observed in the reduced or restricted areas of ribbon elements that normally provide arc voltage control used in comtemporary fuses. Although the wire elements in the diameter sizes which would be used in fuses of this type are mechanically strong, additional support against the rotational forces could be provided by using a solidified sand fill 11 that surrounds the shielding tube 6 and completely fills the interior of the insulating tubular housing 2. To enhance this type of support, the element wires could be given a slight spiral as opposed to being kept straight.

Figure 3A:
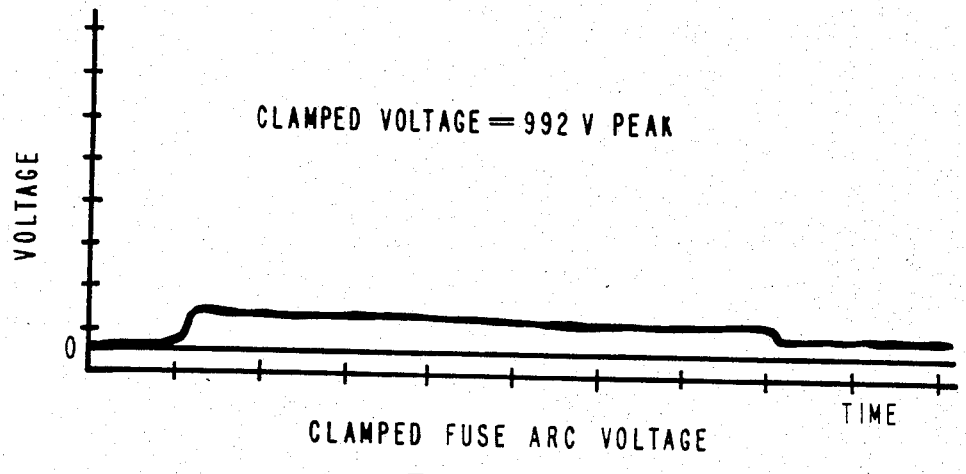
FIG. 3A is an arc voltage waveform of a typical current limiting fuse incorporating the principles of this invention.
Figure 3B:
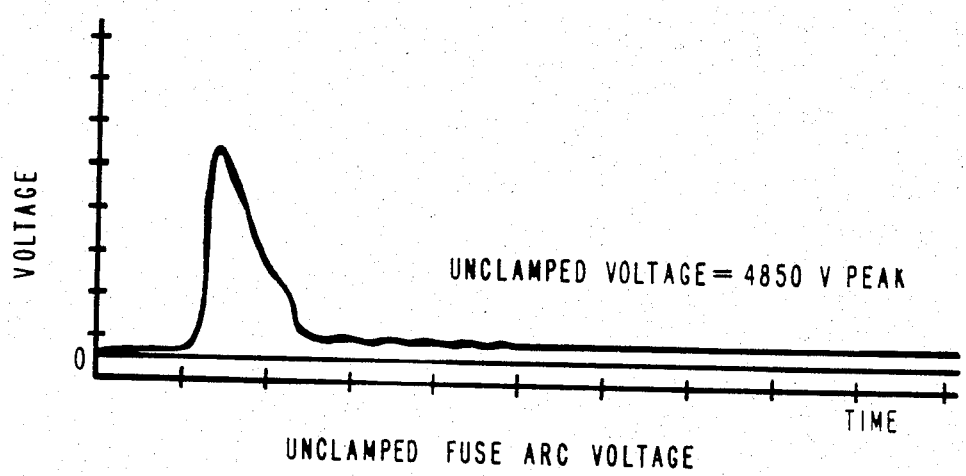
FIG. 3B is an arc voltage waveform of a current limiting fuse without arc voltage control and shaping characteristics.

The zinc oxide cylinder 1 is electrically connected in parallel with the array of fuse elements to provide arc voltage shaping and control characteristics. FIGS. 3A and 3B illustrate the arc voltage control of a fuse built in accordance with the principles of this invention. FIG. 3A illustrates the effect of the zinc oxide cylinder as compared to an uncontrollable arc voltage fuse design shown in FIG. 3B. As can be seen in FIG. 3B the current limiting fuse with uncontrolled arc voltage generates a voltage waveform with a peak value of 4850 volts while a similar fuse incorporating a zinc oxide cylinder for controlling the arc voltage limits the arc voltage spike to a maximum 992 volts peak. Note that the clamped arc voltage shape has also been extended in time and now approximates the ideal rectangular shape desirable for rapid and efficient fault current interruption.

Although there has been illustrated and described a specific structure, it is to be clearly understood that the same were merely for purposes of illustration and that changes and modifications may be readily made therein by those skilled in the art without departing from the spirit and scope of this invention.

We claim:

1. A fuse, comprising:

(a) an insulating housing;

(b) electrically conductive terminal means at each end of said insulating housing for sealing the ends thereof;

(c) a plurality of fuse elements traversing the length of said insulating housing electrically connected to the electrically conductive terminal means;

(d) a non-linear resistance means comprised of a zinc oxide formulation for controlling and shaping the arc voltage developed during current interruption electrically connected in parallel with said plurality of fuse elements; and (e) solidified sand completely filling said insulating housing and surrounding the contents thereof.

2. A fuse as recited in claim 1 having a shielding means for enclosing said non-linear resistance means shielding the non-linear resistance means from arc products during current interruption.

3. A fuse as recited in claim 2 wherein said shielding means is generally a hollow insulating tube.

4. A fuse as recited in claim 1 wherein the sand completely filling the insulating housing is granular.

5. A fuse per claim 1 wherein elements are uniform in cross section.

* * * * *